United States Patent [19]

Dunn

[11] Patent Number: 4,466,534

[45] Date of Patent: Aug. 21, 1984

[54] DISPLAY PACKAGES

[76] Inventor: J. Malcolm Dunn, 305 Via Montego, San Clemente, Calif. 92672

[21] Appl. No.: 417,149

[22] Filed: Sep. 13, 1982

[51] Int. Cl.[3] ..... B65D 25/54

[52] U.S. Cl. ..... 206/45.34; 206/462; 206/463; 206/475; 206/566

[58] Field of Search ..... 206/0.82, 0.83, 0.84, 206/45.34, 45.31, 564, 566, 475, 461, 462, 463, 486, 523, 588, 592; 150/37, 39, 41, 34

[56] References Cited

U.S. PATENT DOCUMENTS

| | | | |
|---|---|---|---|
| 3,173,540 | 3/1965 | Lapides | 206/462 |
| 3,193,090 | 7/1965 | Hudgeons, Sr. et al. | 206/0.83 |
| 3,202,278 | 8/1965 | Taylor | 206/471 |
| 3,245,523 | 4/1966 | White | 206/0.83 |
| 3,249,217 | 5/1966 | Irving | 206/461 |
| 3,288,281 | 11/1966 | Sparks | 206/461 |
| 3,788,464 | 1/1974 | Skinner | 206/0.82 |
| 4,099,611 | 7/1978 | Feibelman | 206/566 |
| 4,275,810 | 6/1981 | Waldweier | 206/45.34 |
| 4,320,831 | 3/1982 | Szabo et al. | 206/45.34 |
| 4,350,249 | 9/1982 | Caston | 206/486 |
| 4,364,472 | 12/1982 | Waldweier | 206/45.34 |

*Primary Examiner*—William T. Dixson, Jr.
*Assistant Examiner*—Bryon Gehman
*Attorney, Agent, or Firm*—Grover A. Frater

[57] ABSTRACT

A display package for small, high value objects such as gem stones utilizes a double sided adhesive insert between a pair of cover members each of which is bonded to a respectively associated one of the adhesive sides of the insert. The article to be displayed is sandwiched between window elements, and in some forms cushion and background elements which are themselves bonded to respectively associated adhesive sides of the insert.

8 Claims, 13 Drawing Figures

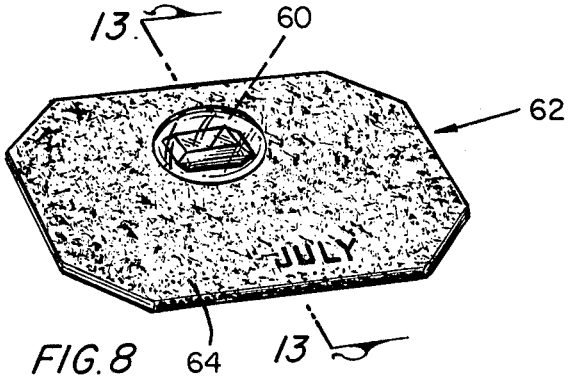
FIG. 8
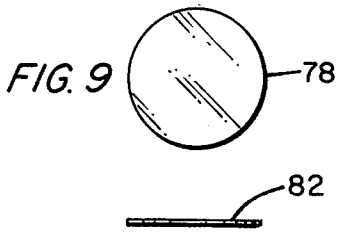
FIG. 9
FIG. 10
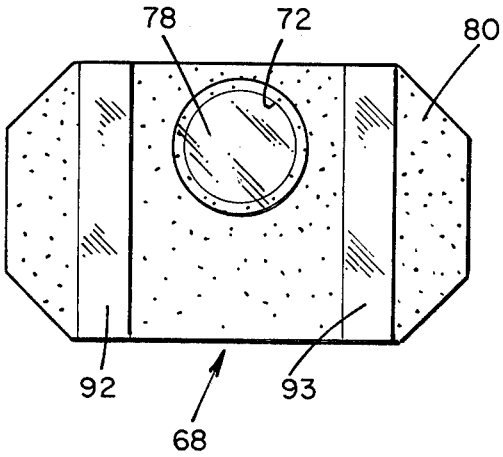
FIG. 11
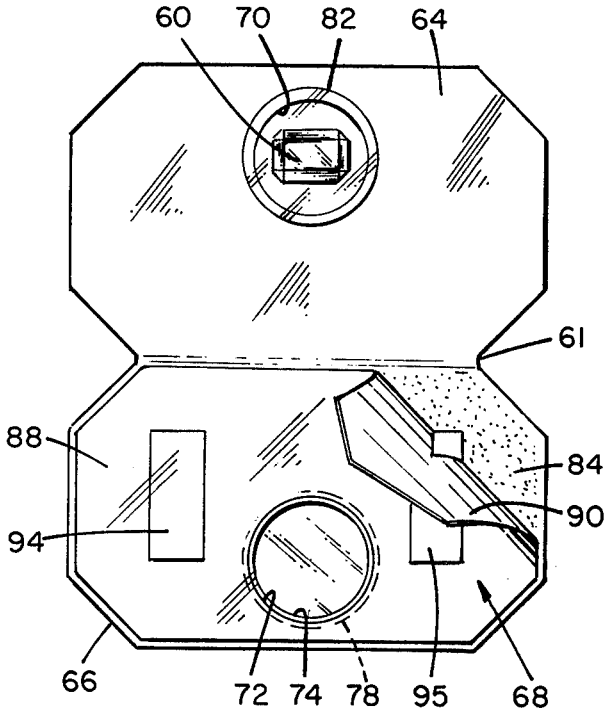
FIG. 12
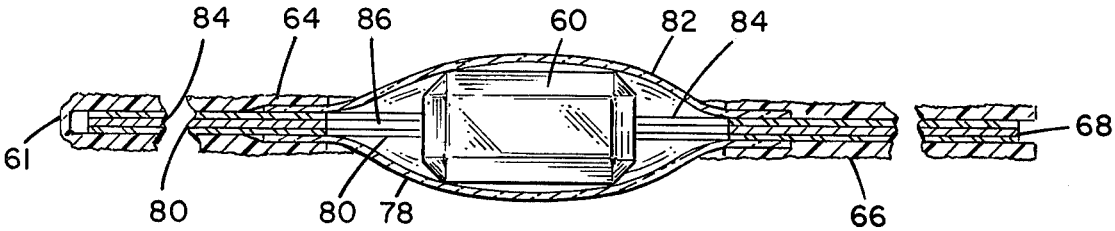
FIG. 13

DISPLAY PACKAGES

TECHNICAL FIELD

This invention relates to methods and to means for display packaging of small articles.

BACKGROUND ART

Display packaging has become an important and complex art. Its primary function has been to permit customers to see and evaluate products prior to purchase. The cost of inventorying and selling goods often approaches and even exceeds the cost of production. In many instances the proposed selling price or the value of the goods to prospective buyers is too low to permit selling by a salesperson qualified to assist the buyer in deliberations about a purchase. To display a product in a package in which it is visible and which bears information about quality, utility, price, etc. is often a much more reliable way to inform potential customers than to rely on the memory of a salesman responsible to assist in the sale of many products.

Pressures to reduce distribution costs has given steadily increasing importance to display packaging, and have resulted in attempted extension of its use to new kinds of products. Thus, for example, attempts have been made to extend display packaging to small, high value articles. The purpose of packaging is to segregate and protect goods and to provide surfaces on which information can be imprinted. The display quality is incorporated to permit inspection by the prospective purchaser. That implies handling by the prospective purchaser and, in the case of small, high value products, it implies opportunity for theft and increased exposure to attempted theft.

The display package creator has as his task to create a package which accommodates the product's size and shape, which permits adequate viewing, which can withstand handling, which provides adequately for explanatory material and brand name identification, which incorporates aesthetic appeal, and which discourages theft. The task is to provide all that and, invariably in practice, to provide it at minimum cost. Many display packages in the past have met those criteria. However, little has been done to provide display packaging which will also serve as the after sale storage receptical for the product.

Objects like postage stamps, collector coins, and gem stones which are purchased for other than utilitarian values can also be the subject of display packaging and for such goods the display package can be made to serve both as a storage receptical and as a means to enhance appeal of the goods.

The spring-closed, satin-lined, individual box for rings and jewelry is an example. However, such boxes do not meet some of the other criteria that is imposed on display packaging. They cannot, for example, deter theft.

The past has not produced a display package which combines low cost, long shelf life, the ability to withstand much handling, aesthetic appeal, ability to enhance the appearance of goods, deter theft, require minimum storage space, and serve as a permanent storage container for the goods. In particular, the display packaging of the past for small, high and medium value non-utilitarian goods has been less desirable and satisfactory than what this invention has shown to be possible.

Gem stones have been particularly difficult to package. Unlike stamps and coins, which are often collected and stored and displayed in sets or with many others, gem stones are often owned and displayed singly. They are customarily displayed by incorporating them into a piece of jewelry or, if unmounted, by holding them unprotected in the viewer's hand. A display package in which unmounted gem stones can be both protected and adequately viewed has not been available.

DISCLOSURE OF INVENTION

It is an object of this invention to provide an improved display package.

More particularly, it is an object to provide a display package, especially for small objects, which can have most or all of the qualities described above including high aesthetic appeal, ability to enhance the appearance of the goods it contains, long shelf life, ability to withstand much handling, low cost, and other qualities.

Another object is to provide improved display packaging for stamps and collector coins and like nonutilitarian objects and gem stones in particular.

Another object is to provide a display package which can be readily assembled by persons with physical and mental handicaps. In this connection, it is an object to provide a method for making and assembling display packaging which lends itself to accomplishment by handicapped persons.

These several objects and advantages are achieved by the provision of a package formed by a pair of covering members bonded together by a double sided adhesive layer except at a viewing opening formed through the thickness of at least one of the covering members. A transparent pane is fixed under the viewing opening, in the preferred form, by being bonded to the adhesive layer facing the covering member under which the pane is disposed.

In one preferred form of the invention, two such panes arranged in juxtaposition and each attached to a respectively associated side of the double adhesive layer combine to form a see-through window. A coin or gem stone trapped between the panes may be viewed from either side of the package whereby it can be viewed completely.

In another form, one covering member is formed without the window opening but has its interior surface colored, or covered with a colored cushioning material bonded to the adhesive layer around the window at the side way from the pane. In a display container for a nearly transparent gem stone the colored material may be a black light absorbing felt or the like whereby its transparency is utilized to enhance the gem aesthetic quality.

Embossing to shape the covering member and thereby to control the shape of panes and cushioning materials adds to the aesthetic quality of the package when the covering member is formed of relatively thin material.

To facilitate assembly and to simplify their registration, the covering members may be integrally formed from a single sheet of material which is folded such that one member overlies the other. Further, in the preferred embodiment, the double adhesive layer is formed by individual layers of pressure sensitive adhesive applied to opposite sides of a base sheet material except at regions which are to form finger holds during assembly.

Alternatively, the two adhesive layers are covered by protective peel-away overlays which are peeled away except at the finger hold areas.

These and other features of the invention which will become apparent can be more easily understood and envisioned by examination of the accompanying drawings which illustrate what is believed to be the best mode for practicing the invention in several preferred embodiments and by a reading of the following description of those embodiments:

BRIEF DESCRIPTION OF THE DRAWINGS

In the Drawings:

FIG. 1 is an isometric view of an embodiment of the invention in which a gem stone is displayed behind a transparent window pane against a light absorbing background in a wallet shaped display package;

FIG. 2 is an isometric view of the transparent disc that forms the window pane in FIG. 1;

FIG. 3 is an isometric view of the background element of the embodiment of FIG. 1;

FIG. 4 is an isometric view of the adhesive insert with its protective overlays in place showing its upper surface;

FIG. 5 is an isometric view of the adhesive insert showing the lower surface with its protective overlay removed;

FIG. 6 is an isometric view of a fraction of the package of FIG. 1 shown at an intermediate stage in its assembly;

FIG. 8 is an isometric view of another display package in wallet form in which a gem stone is displayed between a pair of transparent windows;

FIG. 9 is a front view of one of the window panes of FIG. 8;

FIG. 10 is an edge view of the other of the window panes of FIG. 8;

FIG. 11 is a plan view of the lower side of the adhesive insert with the lower protective overlayer removed and one of the window panes assembled with it;

FIG. 12 is a plan view of the package of FIG. 8 at one stage in its assembly; and FIG. 13 is a fragmentary, cross-sectional view taken on line 13—13 of FIG. 8.

DESCRIPTION OF THE PREFERRED EMBODIMENTS

Figure 7:
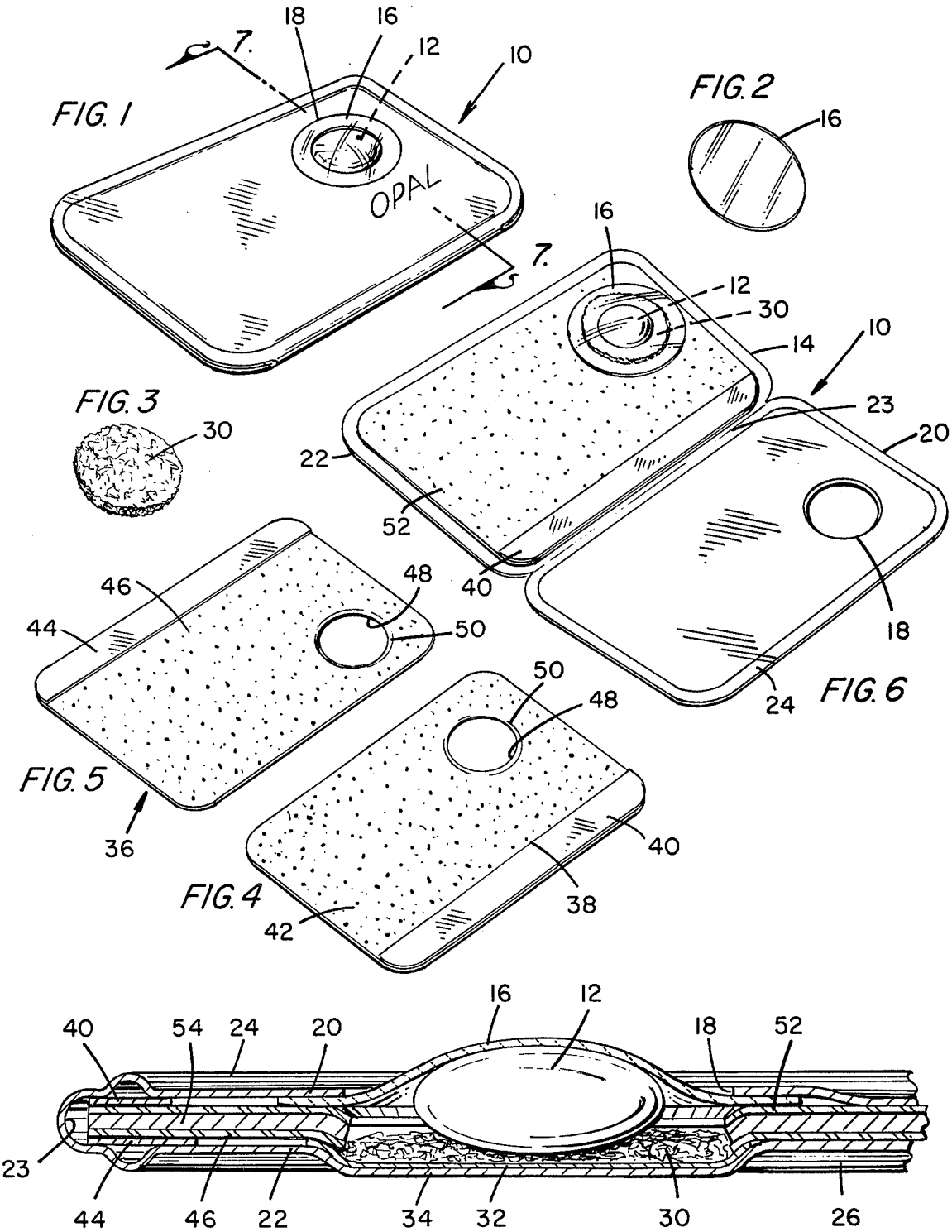
FIG. 7 is a greatly enlarged cross-sectional view of a fraction of the package as it appears when viewed on line 7—7 of FIG. 1.

The display package 10 of FIG. 1 illustrates how the invention may be employed in the display of an unmounted gem stone. The package is designed to be used both as a means for showing the stone to prospective purchasers and as a means by which the purchaser may display it after purchase.

In this example the stone 12 is a disc shaped opal about one cm in diameter. It is mounted in a paper wallet 14 on a background of black light absorbing synthetic velvet behind the clear plastic "pane" 16 of a circular window 18.

The wallet 14 is formed by front and back cover sheets of material bonded together with an adhesive bonding means. The window 16, the stone 12, and the background material forming a "sub-sandwich" which is sandwiched between the front and back covers of wallet material. In this case the front cover 20 and back cover 22 are formed of colored chromed card stock. They are integrally formed, die cut and creased along center line 23. The front and back have the same size and shape, and when folded together their cut edges register substantially exactly.

To lend a feeling of bulk and substance, a trim bead has been embossed outwardly, toward the front of the front cover and toward the back of the back cover, entirely around both sheets. That trim bead is numbered 24 in the case of the front cover and 26 in the case of the rear cover.

The transparent window pane 16 is shown in FIG. 2. It is formed by a thin disc of highly transparent plastic. In this case a clear mylar of the kind that can be stretched in small degree. The cushion 30 is shown in FIG. 3. In this embodiment it is a "velvet" disc made by bonding synthetic velvet material to a backing sheet 32.

As best shown in FIG. 7 the back sheet 22 of the wallet has a shallow protrusion 34 embossed rearwardly (downwardly in FIG. 7). The protrusion forms a pocket in which the velvet cushion 30 is disposed. It is circular about an axis that is coincident with the axis through the center of window 18 of the front sheet. The gem 12 rests on the cushion. The pane 16 overlays the gem and the margins of the pane underlie the margins around the window opening 18.

To complete the product the two sheets 20 and 22 of the wallet must be fastened together. To preserve and enhance the appearance of quality that can be achieved by color and material selection, it is necessary that the upper and lower sheets be bonded securely entirely around the window and entirely around the margins of the wallet. In the interest of security the bond must be strong and secure and extend over most of the adjoining surfaces of the covers.

A number of pressure sensitive adhesive substances are available and they can be compounded to adhere to papers and other materials as tenaciously as may be desired. Moreover, they are easily applied as thin coatings on sheet materials. It would seem logical to coat one or both of the faces of the sheets to be joined with such an adhesive and to bring the two sheets together whereby to bond them together. That can be done, and that is, in fact, a prior art technique.

To use other than pressure sensitive adhesives greatly increases cost. The pressure sensitive adhesives can be protected until the time of use by overlays of sheet materials to which the adhesive will adhere less tenaciously than to itself and to base material sheets on which the adhesive layer is carried. However, the very qualities that are relied on to make the pressure sensitive adhesives practical make them troublesome in applications such as this display package. Pressure sensitive adhesives do not harden entirely. They tend to migrate. If allowed to migrate at the edges of this or other display packages, a line of adhesive becomes exposed. Dust and other soils attracted to the adhesive, often electrostatically, soon turn the margins into something unpleasant to touch and see.

It would be inexpensive to coat sheets of cover material with pressure sensitive adhesive, apply a peel-away protective overlayer and then die cut wallets. But the migration problem precludes that where shelf life is important. In fact, because perfect registration of the uncut edges is not possible, the problem of soil at the edges appears almost immediately. Moreover, when, as here, one objective is to provide a method which handicapped persons can practice, the need for absolutely precise registration defeats the objective. Trimming after sealing the stone in the wallet is very costly because the inclusion of the stone results in dimensional variations not only in thickness at the stone but in position of the stone.

There are other problems with direct application of adhesive to cover stock. One is that embossing becomes very difficult and impractical after the adhesive is applied. It is possible to "print" adhesive on selected areas of the mating cover surfaces after the covers are die cut. The range of adhesive materials that can be printed and the range of adhesive qualities among those that can be printed are both limited. Moreover, the process is costly. It is difficult to control registration of the adhesive coating and the quantities in production runs, and therefor, unit costs to amortize set-up costs vary greatly. That is especially true in the case of gem stones. In the case of higher valued stones, a production run may be only a few hundred pieces.

In the invention the problem of fastening the wallet covers together is solved by providing a separate insert between the covers to which both covers are bonded. At least one side, but preferably both sides, of the insert are coated with a pressure sensitive adhesive. It is possible in the invention to "print" adhesive to one cover and to coat only one (or both) sides of the insert, but reliance on adhesive coatings on both sides of the insert is preferred. the coatings are applied to a base sheet and are protected by a peel-away overlayer. Thus prepared, the insert can be die cut to a size and shape that is easily positioned between the wallet covers such that no adhesive lies immediately the cut edges of the covers or of the window opening.

The insert 36 of the wallet of FIG. 1 is shown in FIG. 4 with its upper, peel-off covering in place. The covering has been scored completely through line 38 whereby it is divided into a narrow strip 40 and a main portion 42. The peel-away protective overlayer on the opposite side is divided in similar fashion into a narrow strip 44 which may be seen in FIG. 5, and a main portion not visible in the drawings. The main portion of the overlay having been peeled away, the adhesive layer 46 is visible. The window opening 48 in the insert 36 extends entirely through the insert including both protective overlays-both adhesive layers and the base sheet which carries the adhesive. In this design the margin 50 of the window opening is embossed and "extruded" out of the plane of the sheet in small degree to form a rim which will extend toward the lower cover embossement 34.

During assembly the narrow strips 40 and 44 of overlay material serve as finger holds by which the assembler may hold the insert 36 without touching the adhesive surfaces. The overlayer material is selected to have renitance to exceed the force with which it is held to the layer it protects so the bending of the insert will result in a separation of the overlayer at the bend whereby to facilitate its removal. In the preferred procedure the large area of overlayer material is removed from the side of the insert which will lie against the inner face of lower cover 22. The overlayer on the other side is not removed at this tep and the insert has the condition depicted in FIG. 5.

The cushion 30 is then placed against layer 46, cushion or velvet side toward the layer, and is bonded thereto. It is placed so that its center overlies the center of window 48 as nearly as is easily possible. That is done by placing the cushion so that its margins overlie the embossed rim 50 of the window opening. The cushion need not be forced hard against the adhesive material to make it adhere, but no harm is done by applying a relatively large force. Any distortion of the rim will be corrected in subsequent assembly steps.

The cushion having been attached to the insert, the next step is to position the insert over the inner surface of the back cover and lower it into position. The strip 44 extends from side to side of the insert so that it can be grasped with the fingers of one hand, or both hands. It can be placed in position by positioning one edge first and then simply laid down in place. The insert is sized so that the adhesive layer ends just short of the margins of the wallet's front and back.

The insert is placed on the inner side of the back with the protective overlayer strip 44 in place and positioned adjacent the fold line at which the front and rear cover sheets are joined. It is shown so positioned in FIG. 6. There is no need to remove the strip 44 when placed adjacent the fold and, in this case, it is left in place as best shown in FIG. 7.

The next step is to remove the large area, protective overlayer 42 from the upper edge of the insert. That done, the upper adhesive layer 52 is exposed. The next task is to position the stone and transparent window pane in preparation for closing the front cover and adhesive layer 52 together. Whether it is best to place the pane and stone on the inner side of the front cover and close the insert and rear cover down upon them, or best to do the reverse procedure, depends in large measure on the size and shape of the stone. In this example, the stone 12 has been placed on the cushion 30 and the pane 16 placed on the stone. Pushing an edge of the pane into contact with the adhesive layer 52 holds it in place. Once the insert has been put in place, the fingerhold is no longer required. The upper peel-away layer may be entirely removed if desired and, in fact, the division into two areas is not essential. In the interests of freedom to vary the assembly process, the form shown is preferred. Moreover, since there is no need to remove the strip 40, it has been left in place.

The final step is to fold the front cover over the pane, stone, and adhesive layer 52. That done, the stone is displayed in a way that permits full appreciation of whatever beauty it has. The sheer strength of the plastic window pane precludes a shoplifter from breaking the pane to remove the stone with obvious and readily detected effort. The covers of the wallet cannot be pulled apart and the material of base layer 54 of the insert is selected for its resistance to tension. The package can be cut easily when the purchaser elects to remove the stone, but stealing the stone ordinarily requires stealing the package. The package may be made too large to fit into most pockets. The wallet shown is four inches by six inches. It is easily stored, has long shelf life, and adequate surface area to permit inclusion of an aesthetic setting for the stone and a sales or other message.

Moreover, the end product does not require a high degree of manual skill to assemble in very acceptable form. Merely pressing down on the upper cover around the margins of the window will shape the package elements to the form shown in FIG. 7.

The birthstone for July is the ruby, and it is a ruby 60 that is mounted in the see-through package of FIG. 8. In this embodiment, the wallet material is a vinyl plastic, die cut, and heated at the fold line to form a hinge 61. The wallet 62 is formed by a front cover 64 which is seen in FIGS. 8, 12 and 13, a rear cover 66 which is visible in FIGS. 12 and 13, and an insert 68 which is visible in FIGS. 11, 12 and 13. A viewing window is formed entirely through the front cover where it is numbered 70, the insert 68 where it is numbered 72, and the rear cover where it is numbered 74. As best seen in FIG. 12, the diameter of the window opening 72 through insert 68 is a little larger than the diameter of the opening 74 of the rear cover. The two window openings 70 and 74 of the two covers have the same diameter. In the completed wallet the centers of the openings will lie on a common axis.

There are two window panes in this version of the invention. They are alike. Pane 78 is shown in FIG. 9. In the finished product it is bonded to the adhesive layer 80 at the rearward side of insert 68. Pane 82 is shown from the edge in FIG. 10. It is bonded to the upper adhesive surface 84 of insert 68 in the finished product.

The insert 68 is formed by a base layer 86 of sheet material (see FIG. 13). It bears the lower adhesive coating 80 at its underside and the upper adhesive coating 84 at its upper side. The upper coating 84 is protected prior to assembly by a peel-away sheet 88 which is shown in FIG. 12 in the process of being removed. One corner 90 has been pulled up to expose the adhesive layer 84. A like pull-away sheet covers the adhesive layer 80 in the original condition of the insert. Both pull away sheets are scored entirely through to separate two areas, rectangular in this case, from the remainder of the sheet. In each case these areas lie one on each side of the window opening. They are finger hold areas and those on one side of the insert generally overlie those on the other side. These portions of the pull away sheets remain when the sheets are peeled away. In FIG. 11, the two back side finger holds are numbered 92 and 93, respectively. They both extend the width of the insert and are positioned away from the ends of the insert. The two front side finger holds are visible in FIG. 12 and are numbered 94 and 95, respectively. They overlie smaller, rectangular areas of the adhesive layer whereby all but the finger holds of the peel-away layer may be removed as a single piece. The numeral 68 is used here to designate the insert in any of its several conditions. That is with the peel-away cover sheets in place or removed.

To assemble this wallet, the covers are laid out flat, inner sides up as shown in FIG. 12. The peel-away protective coating, except the finger hold areas, is pealed from one side of the insert to expose the adhesive layer at that side. A window pane disc is then centered over the insert window opening and is lowered to the adhesive layer and is bonded to it so that it lies flat in the plane of the adhesive layer.

The insert 68 is placed over the rear cover 66 such that the margins of the pane (pane 78 in the drawing) overlie the margins of opening 74 as indicated by the dashed line in FIG. 12. The finger pads 92 and 93 at the lower side and any part of the upper protective layer are available for holding and positioning the insert.

The insert in place, the next step is to peel away the protective layer 88 to expose the adhesive layer 84. The finger pad areas 94 and 95 will remain in this design but are not required. Their inclusion only makes the insert reversable. Again, there are two ways to proceed. The stone and transparent pane may be laid over the pane 78 and the front cover pivoted over on to that assembly and adhesive layer 84 or the pane 78 and stone 60 may be laid on the front cover 64 as shown in FIG. 12 and the rear cover 66 and insert 68 pivoted over the front cover, window pane 82 and stone.

The latter procedure results in the stone being positioned so that its midplane lies nearly on the midplane of the wallet. To move the stone to a more forward position in the finished product, it and window 82 are placed on window 78 and the upper, front cover is rotated down on them and adhesive layer 84.

In certain cases, particularly where the gem stone or other article to be displayed, is relatively thin, it may be preferred to bond the cushion or a colored or reflective patch, or the like, to the adhesive layer of the insert at the side toward the front cover. The article to be displayed would be placed on that cushion or patch and the window pane placed on top of the article. The cover would be closed on the assembly of pane article and patch as before such that the article would be visible through the pane as before. In that embodiment, the window opening of the insert may, but need not be, omitted.

Although I have shown and described certain specific embodiments of my invention, I am fully aware that many modifications thereof are possible. My invention, therefore, is not to be restricted except insofar as is necessitated by the prior art.

What is claimed is:

1. In a display package:

front and back covers each having inner and outer surfaces and having free edges along at least a portion of their respective margins and said front cover having a display opening formed therethrough;

an insert comprising a base sheet having a front and back side and having a display opening formed therethrough having a size no less than that of said display opening of the front cover the margins of the cover extending beyond the margins of the insert;

the insert further comprising two layers of adhesive one at its front side and the other on its back side and extending to the margin of the display opening, said layers of adhesive being bonded to the inner surfaces of said front and back covers, respectively; and a transparent window pane having a size exceeding that of the display opening of said insert and interposed between said inner surface of the front cover and the adhesive layer at the front side of the insert;

the pane and the display openings of the front cover and insert being aligned each with the others; and an article to be displayed disposed in said display opening of said insert.

2. The invention defined in claim 1 in which the rear cover is formed with a display opening and which comprises a second transparent window pane;

the second pane being disposed between the back cover and the adhesive layer on the back side of said insert, the second pane and the display opening of the back cover being aligend with one another and the first mentioned pane and the display openings of the insert and front cover.

3. The invention defined in claim 2 in which said covers are integrally formed along a common fold line.

4. The invention defined in claim 3 which further comprises a finger pad in the form of a layer of material overlying the adhesive layer on at least one side of said insert.

5. The invention defined in claim 4 in which said finger pad is disposed between one of said covers and said insert adjacent to said fold line.

6. The invention defined in claim 1 which further comprises a cushion element having a size exceeding that of said display opening of the front cover and disposed in alignment with said pane and the display openings of the front cover and insert.

7. The invention defined in claim 6 in which said cushion is bonded at its margins to the adhesive layer at the back of said insert to the margins of the display opening of the insert.

8. The invention defined in claim 7 in which the back cover is formed with a recess extending in the direction away from said insert and in which said cushion is disposed.

* * * * *